US005080063A

United States Patent [19]

Augustin

[11] Patent Number: 5,080,063

[45] Date of Patent: Jan. 14, 1992

[54] MECHANICAL SPEED GOVERNOR, PROVIDED WITH AN ELECTRONICALLY CONTROLLED ADAPTING DEVICE, FOR AN INJECTION PUMP OF COMPRESSION IGNITION INTERNAL COMBUSTION ENGINES

[75] Inventor: Ulrich Augustin, Kernen, Fed. Rep. of Germany

[73] Assignee: Dr. Ing. h.c.F. Porsche AG, Fed. Rep. of Germany

[21] Appl. No.: 447,817

[22] Filed: Dec. 8, 1989

[30] Foreign Application Priority Data

Jan. 21, 1989 [DE] Fed. Rep. of Germany ..... 3901722

[51] Int. Cl.[5] ..... F02D 31/00

[52] U.S. Cl. ..... 123/357; 123/366; 123/373

[58] Field of Search ..... 123/358, 357, 373, 365, 123/366, 367, 374

[56] References Cited

U.S. PATENT DOCUMENTS

| | | | |
|---|---|---|---|
| 4,112,897 | 9/1978 | Hufendiek | 123/366 |
| 4,204,510 | 5/1980 | Ritter | 123/366 |
| 4,223,653 | 9/1980 | Jaenke | 123/366 |
| 4,243,004 | 1/1981 | Ritter | 123/367 |
| 4,252,089 | 2/1981 | Kramer | 123/365 |
| 4,305,362 | 12/1981 | Schwartz | 123/367 |
| 4,729,357 | 3/1988 | Freudenschuss | 123/365 |
| 4,782,804 | 11/1988 | Lehmann | 123/365 |

FOREIGN PATENT DOCUMENTS

| | | | |
|---|---|---|---|
| 740674 | 11/1955 | Fed. Rep. of Germany | 123/366 |
| 2453576 | 5/1976 | Fed. Rep. of Germany . | |
| 3430797 | 3/1986 | Fed. Rep. of Germany . | |

*Primary Examiner*—Carl Stuart Miller

*Attorney, Agent, or Firm*—Evenson, Wands, Edwards, Lenahan & McKeown

[57] ABSTRACT

The invention relates to a mechanical speed governor, apparatus for an injection pump of compression-ignition internal combustion engines provided with an electronically controlled adapting device. The adapting device is provided for correcting fuel quantity delivered by the pump in the range of the full-load and starting speeds, and is in operative connection with a quantity-control member of the injection pump via a two-step stop. The two-step stop can be transferred as a function of speed from a position corresponding to the starting speed into a position corresponding to the full-load speed.

18 Claims, 1 Drawing Sheet

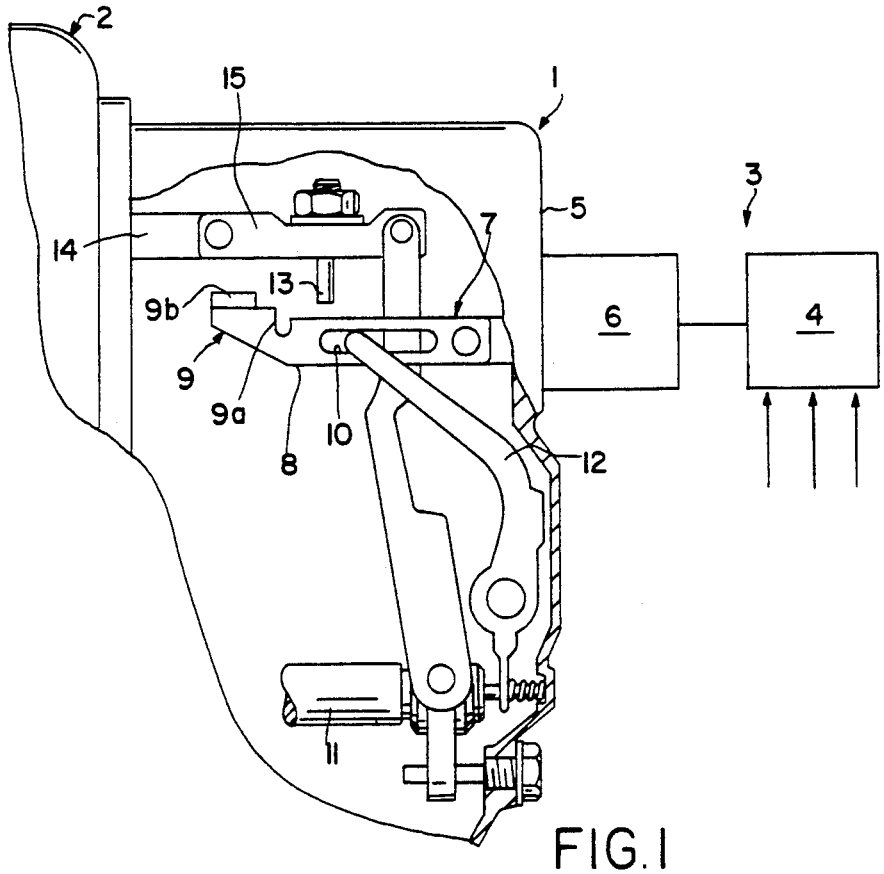
FIG.1
FIG.2
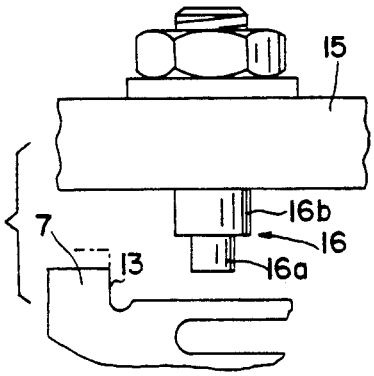
FIG.3
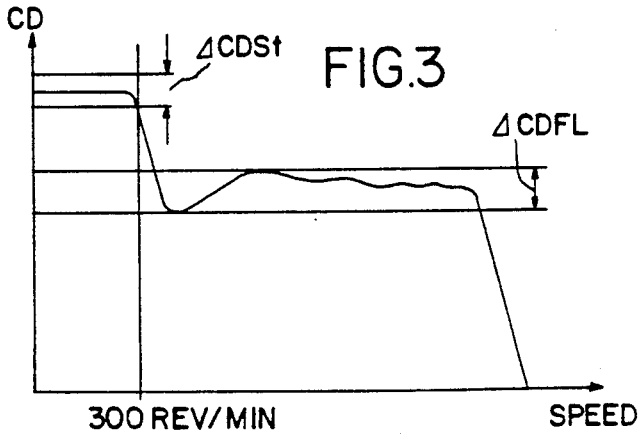

MECHANICAL SPEED GOVERNOR, PROVIDED WITH AN ELECTRONICALLY CONTROLLED ADAPTING DEVICE, FOR AN INJECTION PUMP OF COMPRESSION IGNITION INTERNAL COMBUSTION ENGINES

BACKGROUND AND SUMMARY OF THE INVENTION

The invention relates to a mechanical speed governor, wherein a stepper or servo motor is provided for correcting the quantity of fuel delivered by a fuel pump in the range of full-load and starting speeds of an internal combustion engine. As control unit is provided to process internal combustion-engine and ambient parameters for controlling the stepper-servo motor, which influences the regulating displacement of a quantity-control member of the injection pump in such a way as to correct the quantity of fuel delivered by an injection pump of compression ignition internal combustion engines provided with an electronically controlled adopting device.

DE 3,430,797 Al discloses a speed governor having an electronically controlled adapting device with which the fuel quantity can be corrected. The delivery quantity of the injection pump can be automatically adapted to the fuel requirement of the internal combustion engine in full-load and starting range in order to reduce (as far as possible) damage to the environment and in particular the emission of hydrocarbons.

An object of the instant invention is to create a speed control on a mechanical speed governor having electronically controlled adaption whose quantity-correction range covers the full-load range of the engine and is also used for control during the starting range. In the event of the electronic system failing in the starting position, the speed control will cover a controllable speed range which does not extend beyond the full-load range The object is achieved according to the invention by having the electronically controlled adapting device comprises a two-step stop which is in operative connection with the fuel quantity-control member to limit the starting and full-load quantity and wherein the stop can be transferred as a function of speed from a position corresponding to the starting speed into a position corresponding to the full-load speed.

The invention ensures that in the event of a fault in the adapting device in the starting position, the internal combustion engine is not constantly operated with starting quantity at full load and thus at worst destroyed by overheating. Furthermore, despite the emergency-travelling facility, an electronically controlled adaption with small adapting displacements is possible during regular operation of the internal combustion engine. That is no adaption covering the entire range from full load up to starting quantity is necessary, but merely an adaption which covers the full-load range, since when the two-step stop is shifted the adaption also becomes effective for the starting range.

It is further advantageous if the two-step stop is arranged on a transmission lever connected to the stepper-servo motor to interact with a counterstop on the quantity adjusting member. The quantity-adjusting member consists of a control rod and an fork which contains the counterstop and is connected in an articulated manner to the control rod. The counterstop is formed by an adjustable pin. The transmission lever is designed as a pivot mounted strap, which at its free end has two steps arranged to lie one behind the other in the operative direction of the stepper-servo motor. The first stop (limiting the full-load quantity) is effective when the strap is pivoted to the top, and the second stop (limiting the starting quantity) is effective when the strap is pivoted to the bottom.

The strap has a slotted link on which the adjusting member producing the pivoting movement of the strap is guided as a link slide.

The adjusting member is designed as a double-arm lever and is in operative connection with a centrifugal-weight device of the speed governor.

Other objects, advantages and novel features of the present invention will become apparent from the following detailed description of the invention when considered in conjunction with the accompanying drawings.

BRIEF DESCRIPTION OF THE DRAWINGS

FIG. 1 shows a section through a mechanical speed governor (only partly shown) with adapting device and two-step stop;

FIG. 2 shows another embodiment of the two-step stop, and;

FIG. 3 shows a controlled displacement - speed functional diagram for both exemplary embodiments.

DETAILED DESCRIPTION OF DRAWINGS

A mechanical speed governor 1 (FIG. 1) is provided as an attachment on a fuel injection pump 2 for compression-ignition internal combustion engines. The fuel pump 2 is constructed as an in-line injection pump and is in operative connection with an electronically controlled adapting device 3 which is composed of a stepper or servo motor 6, controlled by an electronic control unit 4, and fixed to the end face of the governor housing 5. The control unit 4 processes internal-combustion-engine and ambient parameters such as speed, charge-air temperature, charge-air pressure, etc. The servo motor 6, electronically controlled by the control unit 4, has a transmission lever 7 output. The transmission lever 7 projects into the speed governor 1 through housing 5 and is designed as a pivot mounted strap 8 with a free end having a two-step stop 9 arranged thereon. The stop 9 has a first step stop portion 9*a* limiting the amount of fuel at full-load and a second step stop portion 9*b* for limiting the amount of fuel during starting. The strap 8 contains a slotted link opening 10 in which an adjusting member 12 is guided as a link slide. The adjusting member 12 is rotatablely mounted in the speed governor 1 and is speed influenced by the governor sleeve 11 of a centrifugal-weight device. This adjusting member 12 is designed as a double-arm lever and produces a pivoting movement of the strap 8 as a function of the speed. In FIG. 1, the adjusting member 12 and the strap 8 are shown in a position corresponding to the starting position. The stop 9*a* interacts with a counter-stop 13 adjustably fixed to an articulated fork 15 that is articulately connected to the control rod 14 of the injection pump 2. The articulated fork 15 and control rod 14 are parts of the quantity-adjustment member of the fuel Pump 2.

Movement of the control rod 14 to the left adjust the fuel delivery amount of the pump 2. The stops 9(*a*) and 9 (*b*) engage the counter stop 13 to stop leftward movement of the control rod 14. The stop 9*a* acts as a variable stop for limiting the starting displacement of the control rod 14 via the bolt-like counterstop 13, whereas the stop 9*b*, when the strap 8 is swung up, variably limits the full-load displacement of the control rod 14 via the counter-stop 13.

FIG. 2 shows that the counterstop 13 can be provided on the strap 8 and the two-step stop can be provided on the articulated fork 15. The bolt 16 is of stepped design. Here the step 16*a*, designed to be smaller in diameter, limits the starting fuel quantity in interaction with the counterstop 13 and the step 16*b* designed to be larger in diameter, likewise limits the full-load quantity in interaction with the counterstop 13, when the strap 8 is swung up (shown as a broken line).

MODE OF OPERATION

When the engine is stopped, the strap 8 assumes the position shown in FIG. 1. The control rod 14 is limited in its movement by the starting-quantity stop 9*b*. After the engine has started (at about 300 rev/min) (see FIG. 3), the adjusting member 12 lifts the strap 7. There the control rod 14 can be adjusted only up to the full-load stop 9*a*. The distance between the stops 9*a* and 9*b* is selected in accordance with the difference in control displacement at full load and at start. In FIG. 3, the adapting displacement at full load is identified by ΔCDFL, and the adapting displacement at start is identified by Δ CDSt Both adapting displacements are the same size and are each effected by the same adapting device. Owing to the small adapting displacements, the adaption can be effected more quickly and the costs can be reduced on account of the use of a smaller stepper motor as a servo motor.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A mechanical speed governor arrangement for controlling a fuel injection pump of a compression-ignition internal combustion engines is provided with an electronically controlled adapting device which controls a motor for correcting fuel quantity delivery of the pump in the range of full-load and starting speeds comprising:

a control unit means for processing internal-combustion-engine and ambient parameters for controlling the motor in response to these parameters;

a regulating displacement quantity-control member for adjusting the quantity of fuel delivered by the fuel injection pump;

wherein the electronically controlled adapting device is provided with a two-step stop means which is in operative connection with the quantity-control member to limit starting and full-load fuel delivered quantities;

and wherein the two-step stop means can be transferred as a function of engine speed from a position corresponding to the starting speed into a position corresponding to the full-load speed.

2. Speed governor according to claim 1 wherein the two-step stop means is arranged on a transmission lever connected to the motor to interact with a counterstop on the quantity-adjusting member.

3. Speed governor according to claim 1, wherein the quantity-adjusting member consists of a control rod and an fork;

wherein the fork is articulately connected to the control rod and wherein the fork supports the counterstop.

4. Speed governor according to claim 2, wherein the quantity-adjusting member consists of a control rod and a fork;

wherein the fork is articulately connected to the control rod and wherein the fork supports the counterstop.

5. Speed governor according to claim 2 wherein the counterstop is formed by an adjustable pin.

6. Speed governor according to claim 4 wherein the counterstop is formed by an adjustable pin.

7. Speed governor according to claim 2 wherein the transmission lever is designed as a pivotably mounted strap and has a free end provided with the two-step stops;

wherein the two-step stops are arranged to lie one behind the other in an operative direction of the motor;

wherein a first step stop of the two-step stops limits the full-load fuel quantity and is effective when the strap is pivoted upwardly;

and wherein the second step stop of the two-step stop limits the starting fuel quantity and is effective when the strap is pivoted downwardly.

8. Speed governor according to claim 4 wherein the transmission lever is designed as a pivotably mounted strap and has a free end provided with the two-step stops;

wherein the two-step stops are arranged to lie one behind the other in an operative direction of the motor;

wherein a first step stop of the two-step stops limits the full-load fuel quantity and is effective when the strap is pivoted upwardly;

and wherein the second step stop of the two-step stop limits the starting fuel quantity and is effective when the strap is pivoted downwardly.

9. Speed governor according to claim 5 wherein the transmission lever is designed as a pivotably mounted strap and has a free end provided with the two-step stops;

wherein the two-step stops are arranged to lie one behind the other in an operative direction of the motor;

wherein a first step stop of the two-step stops limits the full-load fuel quantity and is effective when the strap is pivoted upwardly;

and wherein the second step stop of the two-step stop limits the starting fuel quantity and is effective when the strap is pivoted downwardly.

10. Speed governor according to claim 6 wherein the transmission lever is designed as a pivotably mounted strap and has a free end provided with the two-step stops;

wherein the two-step stops are arranged to lie one behind the other in an operative direction of the motor;

wherein a first step stop of the two-step stops limits the full-load fuel quantity and is effective when the strap is pivoted upwardly;

and wherein the second step stop of the two-step stop limits the starting fuel quantity and is effective when the strap is pivoted downwardly.

11. Speed governor according to claim 7 wherein the strap has a slotted link opening on which an adjusting means is guided as a link slide for producing the pivoting movement of the strap.

12. Speed governor according to claim 8 wherein the strap has a slotted link opening on which an adjusting means is guided as a link slide for producing the pivoting movement of the strap.

13. Speed governor according to claim 9 wherein the strap has a slotted link opening on which an adjusting means is guided as a link slide for producing the pivoting movement of the strap.

14. Speed governor according to claim 10 wherein the strap has a slotted link opening on which an adjusting means is guided as a link slide for producing the pivoting movement of the strap.

15. Speed governor according to claim 11 wherein the adjusting member is designed as a double-arm lever and is in operative connection with a centrifugal-weight of a mechanical speed governor.

16. Speed governor according to claim 12, wherein the adjusting member is designed as a double-arm lever and is in operative connection with a centrifugal-weight of a mechanical speed governor.

17. Speed governor according to claim 13, wherein the adjusting member is designed as a double-arm lever and is in operative connection with a centrifugal-weight of a mechanical speed governor.

18. Speed governor according to claim 14, wherein the adjusting member is designed as a double-arm lever and is in operative connection with a centrifugal-weight of a mechanical speed governor.

* * * * *